US007392901B2

(12) United States Patent
Cameron et al.

(10) Patent No.: US 7,392,901 B2
(45) Date of Patent: Jul. 1, 2008

(54) HOCKEY EQUIPMENT CARRYING CASE

(76) Inventors: Timothy Frazer Cameron, #25 Country Style T. P., Drayton Valley, Alberta (CA) T7A 1L8; Leonard John Cartwright, RR 1 P.O. Box 2 Site 443 Compartment # 6, Drayton Valley, Alberta (CA) T7A 2A1

( * ) Notice: Subject to any disclaimer, the term of this patent is extended or adjusted under 35 U.S.C. 154(b) by 403 days.

(21) Appl. No.: 10/446,088

(22) Filed: May 28, 2003

(65) Prior Publication Data

US 2004/0238384 A1 Dec. 2, 2004

(51) Int. Cl.
*B65D 85/00* (2006.01)

(52) U.S. Cl. ..... 206/315.11; 206/1.5

(58) Field of Classification Search ..... 206/315.1, 206/315.11, 372, 373, 579, 1.5, 485; 294/143, 294/147, 159

See application file for complete search history.

(56) References Cited

U.S. PATENT DOCUMENTS 3,935,977 A * 2/1976 Bonnett ..... 294/147
4,059,209 A * 11/1977 Grisel ..... 294/147
4,179,054 A * 12/1979 Bredehoeft et al. ..... 294/146
4,653,220 A * 3/1987 Olsen, Sr. ..... 43/57.1
4,890,731 A * 1/1990 Mroz ..... 206/315.9
D311,449 S * 10/1990 Paschal ..... D3/294
D355,071 S * 2/1995 Stull ..... D3/260
5,526,927 A * 6/1996 McLemore ..... 206/315.11
D405,499 S * 2/1999 Beauvais ..... D22/139
6,085,455 A * 7/2000 Bracken et al. ..... 43/25.2
6,588,817 B1 * 7/2003 Wadeyka et al. ..... 294/147

* cited by examiner

*Primary Examiner*—Shian T. Luong
(74) *Attorney, Agent, or Firm*—William L. Chapin

(57) ABSTRACT

A carrying case for sporting equipment, particularly hockey sticks and accessories such as pucks includes a block-shaped body which has an upwardly protruding carrying handle, a first longitudinally disposed, vertical side of the body which has formed therein a pair of longitudinally disposed, vertically spaced apart troughs, and a first side lid hingedly fastened to a lower edge of the body, the side lid having formed in an inner surface thereof a pair of troughs shaped similarly to those in the body. Stacked pairs of hockey stick handles are placed in either the lid troughs or body troughs, with the lid pivoted outwardly from the body to an open position; with the lid pivoted to a closed position in contact with the body, the lid and body troughs confront one another to form a pair of closed, longitudinally disposed channels which retain the handles therewithin. The lid is held in a closed position in contact with the body by releasably engageable fastener elements located on the lid and body. A second, accessory compartment lid located on an opposite vertical side of the body, is hingedly secured to the body in a similar fashion, and has formed in an inner surface thereof a concave storage compartment cavity for holding pucks and other accessories.

21 Claims, 7 Drawing Sheets

*Fig. 6*
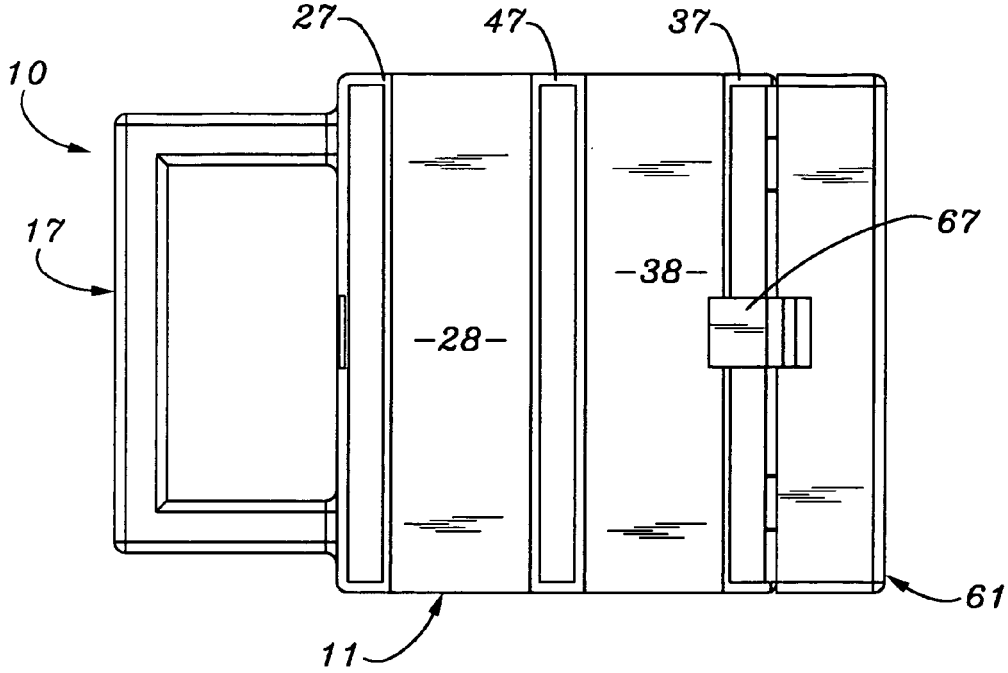
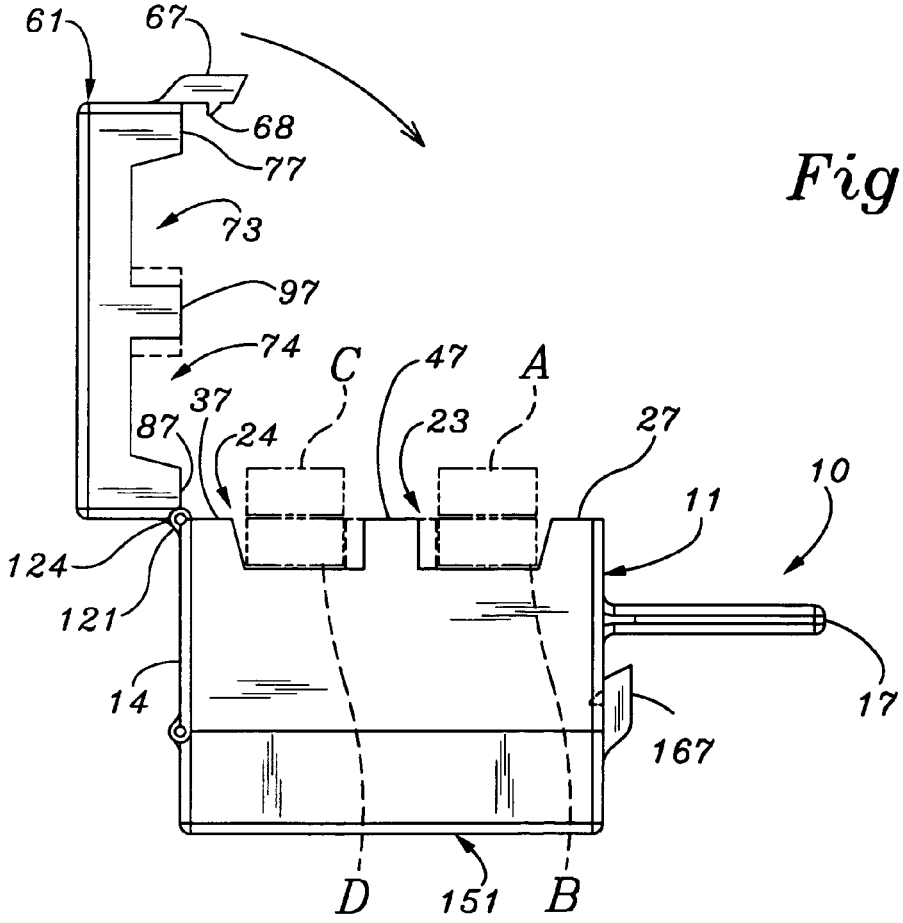
*Fig. 5*

HOCKEY EQUIPMENT CARRYING CASE

BACKGROUND OF THE INVENTION

A. Field of the Invention

The present invention relates to articles useful in transporting sports equipment. More particularly, the invention relates to a hockey equipment carrying case for holding several hockey sticks and related accessory items such as pucks, the case including a handle which enables the case and contents to be conveniently carried by hand.

B. Description of Background Art

There are a variety of existing carrying devices for holding and transporting items of sporting equipment which have elongated shafts, such as hockey sticks. For example, Lamadelein, U.S. Pat. No. 5,249,723, discloses a carrier for shafted equipment such as a pair of hockey sticks, which includes a body having two elongated side-by-side arranged U-shaped channels formed of a resilient plastic material, each of the channels being so dimensioned as to be springingly biased against the shaft of a hockey stick inserted into the channel, thus gripping and retaining the shaft in the channel. A strap attached to opposite ends of the body serves as a shoulder sling for supporting the body and resiliently retained pair of hockey sticks.

Hincher, U.S. Pat. No. 5,758,767, discloses a soft-side hockey stick carrying bag shaped like a hockey stick, including an elongated section and angled shorter end section, the bag having a zipper closed opening for receiving a pair of hockey sticks, and a shoulder sling strap attached to opposite upper ends of the straight, elongated portion of the bag.

Pikel, U.S. Pat. No. 5,954,379, discloses a shafted sports equipment carrier for carrying sports equipment having a long shaft, such as a hockey stick. The carrier consists essentially of a unitary body which has a pair of side-by-side longitudinally disposed, downwardly facing channels which are each resiliently deformable to receive and hold the shaft of a hockey stick, and an upwardly protruding inverted C-shaped carrying handle.

The hockey equipment carrying case according to the present invention was conceived of to provide a carrier for holding and hand transporting various numbers of hockey sticks and associated accessories such as pucks.

OBJECTS OF THE INVENTION

An object of the present invention is to provide a hand carryable hockey equipment carrying case for holding various quantities of hockey sticks and associated accessories such as pucks.

Another object of the invention is to provide a hockey equipment carrying case which has an external shape or form factor similar to that of a hard back suitcase, including a rectangular block-shaped body section with an upstanding, inverted U-shaped handle and a rectangularly-shaped lid mounted on a lower side edge of the body opposite the handle side by a hinge, the lid having in an inner side thereof at least one channel disposed longitudinally with respect to the base of the body, for receiving the handle of a hockey stick and pivotable Into contact with the body and fastenable at that position to retain the hockey stick handle between the lid and body.

Another object of the invention is to provide a hockey stick carrying case which has a longitudinally elongated, rectangular shaped body which has protruding from an upper horizontally disposed wall thereof an upstanding handle, and from an outer edge of a lower horizontal wall thereof a longitudinally disposed hinge which supports a lid pivotably from a closed position in contact with the body to an open position angled away from the body, the lid having formed in an inner side thereof a longitudinally disposed open channel or trough for receiving a hockey stick, and preferably, a mating longitudinally shaped trough formed in an outer side of the body, the body trough forming with the lid trough a composite closed channel of greater depth for holding two hockey sticks, when the lid is closed.

Another object of the invention is to provide a hockey equipment carrying case which includes a body having the shape of a longitudinally elongated, thin rectangular-shaped box with a flat horizontally disposed lower base wall and a parallel upper wall which has protruding vertically upwardly therefrom an inverted U-shaped carrying handle, the body having formed in a first vertically disposed outer side thereof a pair of parallel, longitudinally disposed, vertically spaced apart C-shaped open channels, and a first, stick-compartment side lid which has in side elevation view a shape congruent with that of the body, the first side lid being hingedly mounted to a lower outer edge of the base of the body, and having formed in an inner facing side thereof a pair of C-shaped channels complementary in shape to those in the outer side of the base, the lid channels cooperating with channels in the body, when the lid is closed, to form a pair of upper and lower rectangular cross-section closed channels for receiving upper and lower stacked pairs of hockey stick handles, and on an opposite vertical side of the body, a second, accessory-compartment side lid which has in side elevation view a shape congruent with that of the body, the second lid being hingedly mounted to a lower outer edge of the base of the body, and having formed in an inner facing side thereof a concave compartment for receiving hockey accessories such as pucks, each of the first and second side lids having located on an inner facing upper edge of an upper wall thereof a fastener clamp for releasably engaging a fastener notch formed in each of the opposite sides of the upper wall of the body.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a carrying case for hockey sticks and equipment and accessories used for playing hockey, such as pucks.

A hockey equipment carrying case according to the present invention includes a rectangularly-shaped body which has a shape similar to that of a hardback suitcase. Thus, the body of a hockey equipment carrying case according to the present invention has the shape of a thin, longitudinally elongated box which has rectangularly-shaped, longitudinally disposed left and right vertical sides, vertically disposed front and rear end sides, and rectangularly-shaped lower, base, and upper roof sides. The upper side has protruding perpendicularly upwards therefrom a carrying handle having an inverted U-shape. The body has formed in one longitudinally disposed side thereof at least one and preferably two longitudinally disposed, vertically spaced apart, C-shaped concave channels or troughs which penetrate the front and rear end sides of the body. The case also has a first, "stick compartment" lid which has an outline shape congruent with the channeled vertical side of the body, the lid being pivotably attached to an outer longitudinally disposed edge wall of the base, by a hinge which has a longitudinally disposed pivot axis.

The stick-compartment lid has formed in an inner side thereof a pair of concave C-shaped channels which penetrate front and rear side sides of the lid. When the stick-compartment lid is pivoted upwardly from an open horizontal orientation disposed outwardly from the body, to a vertical closed orientation, in contact with the body, the C-shaped lid channels join the C-shaped channels in the body to form a pair of upper and lower longitudinally disposed, closed rectangular cross-section channels, each adapted to receive a pair of stacked hockey sticks. A springingly deformable fastener element in an inner upper edge wall of the lid is engageable with a complementary fastener groove formed in an outer upper edge of the upper wall of the body. The fastener elements are releasably engageable to secure the stick-compartment lid and body together, thus gripping between bases of the lid and body channels outer sides of a pair of hockey sticks stacked within each channel with the lid open.

A preferred embodiment of a hockey equipment carrying case according to the present invention includes a second, accessory storage compartment lid which has an outline shape similar to that of the stick-compartment lid, and which is located on the opposite side of the body, and pivotably attached thereto in the same manner as the stick-compartment lid. The accessory storage compartment lid has formed in an inner wall surface thereof a concave, hollow rectangularly-shaped compartment adapted to receive accessories such as hockey pucks. The accessory compartment lid is pivotable into contact with the body, and secured to the upper wall of the body by a second fastener similar to that used to secure the stick compartment lid to the body, thus securing accessory items within the accessory storage compartment.

BRIEF DESCRIPTION OF THE DRAWINGS

FIG. 5 is a rear end elevation view of the case shown in FIG. 2, with an accessory compartment lid of the case in a closed position.

FIG. 6 is a left side elevation view of case configured as shown in FIG. 2.

DESCRIPTION OF THE PREFERRED EMBODIMENTS

Figure 1:
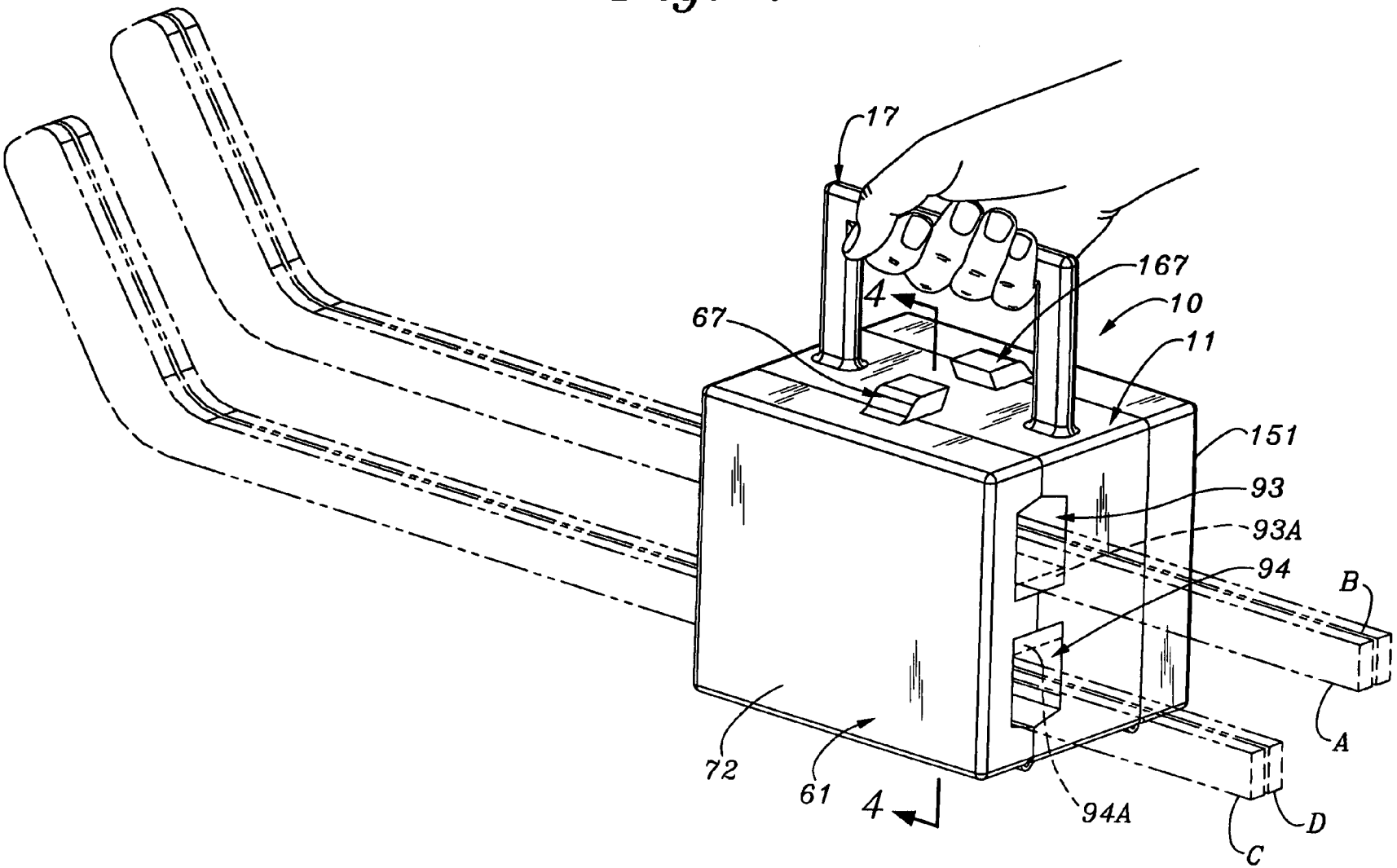
FIG. 1 is a perspective view of a hockey equipment carrying case according to the present invention, showing in phantom two pairs of hockey sticks held in the carrier.
Figure 2:
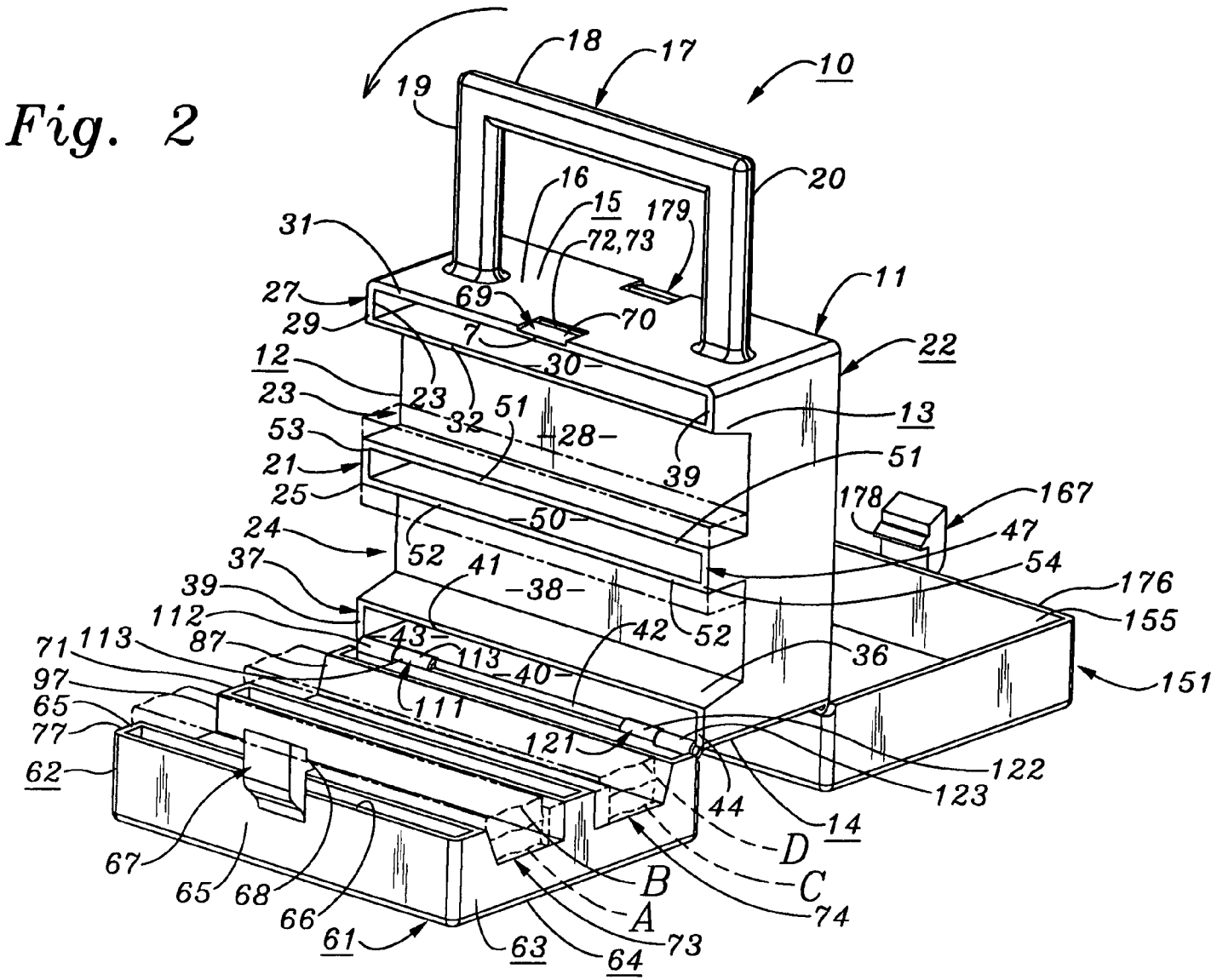
FIG. 2 is a left side perspective view of the carrying case of FIG. 1, showing left and right lids thereof pivoted downwardly from a central body portion of the case, to facilitate receipt within the lids of hockey sticks and accessories, respectively.

FIGS. 1-7 illustrate a hockey equipment carrying case according to the present invention. As is explained in detail below, hockey sticks are conveniently placed in the case as shown in FIG. 2 or 5, and the case closed and held for carrying by a person as shown in FIG. 1.

Referring now to FIGS. 1-7, a hockey equipment carrying case 10 according to the present invention may be seen to include a thin, box-shaped body 11 which has in side elevation view a longitudinally elongated, rectangular shape. Body 11 has vertically disposed, generally rectangularly shaped, parallel front and rear sides 12 and 13, respectively. Also, body 11 has a longitudinally disposed rectangular bottom side 14 and a similarly shaped upper side 15 which is parallel to the bottom side. Upper side 15 has protruding perpendicularly upwards from upper surface 16 thereof an inverted U-shaped handle 17. Although the exact shape of handle 17 is not critical, as shown in FIG. 2, handle 17 has a rigid, horizontally disposed handle bar member 18 which has disposed perpendicularly downwards from front and rear ends thereof front and rear legs 19 and 20. As shown in FIG. 2, handle legs 19 and 20 are centered between left and right sides 21, 22 of body 11, and are optionally formed integrally with the body.

Referring still to FIG. 2, it may be seen that left side 21 of body 11 has formed therein longitudinally disposed, parallel upper and lower, vertically spaced apart open channels or troughs 23, 24. Each trough has a generally C-shaped transverse cross-section, protrudes inwardly from outer face 25 of left-hand side 21 of body 11, and penetrates front and rear walls 12 and 13 of body 11.

Upper trough 23 is bounded on an upper longitudinally disposed side 26 thereof by a longitudinally disposed, rectangularly shaped rib 27 which protrudes perpendicularly outwardly of the inner flat wall surface 28 which comprises the base of the upper trough. Upper rib 27 has a flat outer vertical surface 29 which is coextensive with outer face 25 of left side 21 of body 11. In a preferred embodiment, rib 27 has formed therein a deep, rectangularly shaped cavity 30, to reduce the weight of case 10. Thus constructed, upper rib 27 has in left side elevation view the appearance of a longitudinally elongated, rectangularly shaped shell having thin, uniformly thick upper, lower front and rear horizontally disposed, outwardly protruding walls 31, 32, 33 and 34, respectively.

Referring still to FIG. 2, it may be seen that lower trough 24 is bounded on a lower longitudinally disposed side 32 thereof by a longitudinally disposed, rectangularly shaped lower rib 37 which protrudes perpendicularly outwardly of inner flat wall surface or base 38 of the lower trough. Lower rib 37 is shaped similarly to upper rib 27. Thus, lower rib 37 has a longitudinally elongated rectangular shape which has upper, lower front and rear walls 41, 42, 43, 44, which border a rectangularly shaped cavity 40.

As shown in FIG. 2, upper and lower troughs 23, 24 having disposed therebetween a longitudinally disposed central rib 47, which is shaped similarly to upper and lower ribs 27, 37. Thus, central rib 47 has a longitudinally elongated rectangular shape which has upper, lower, front and rear walls 51, 52, 53, 54 which border a rectangularly shaped cavity 50.

Figure 3:
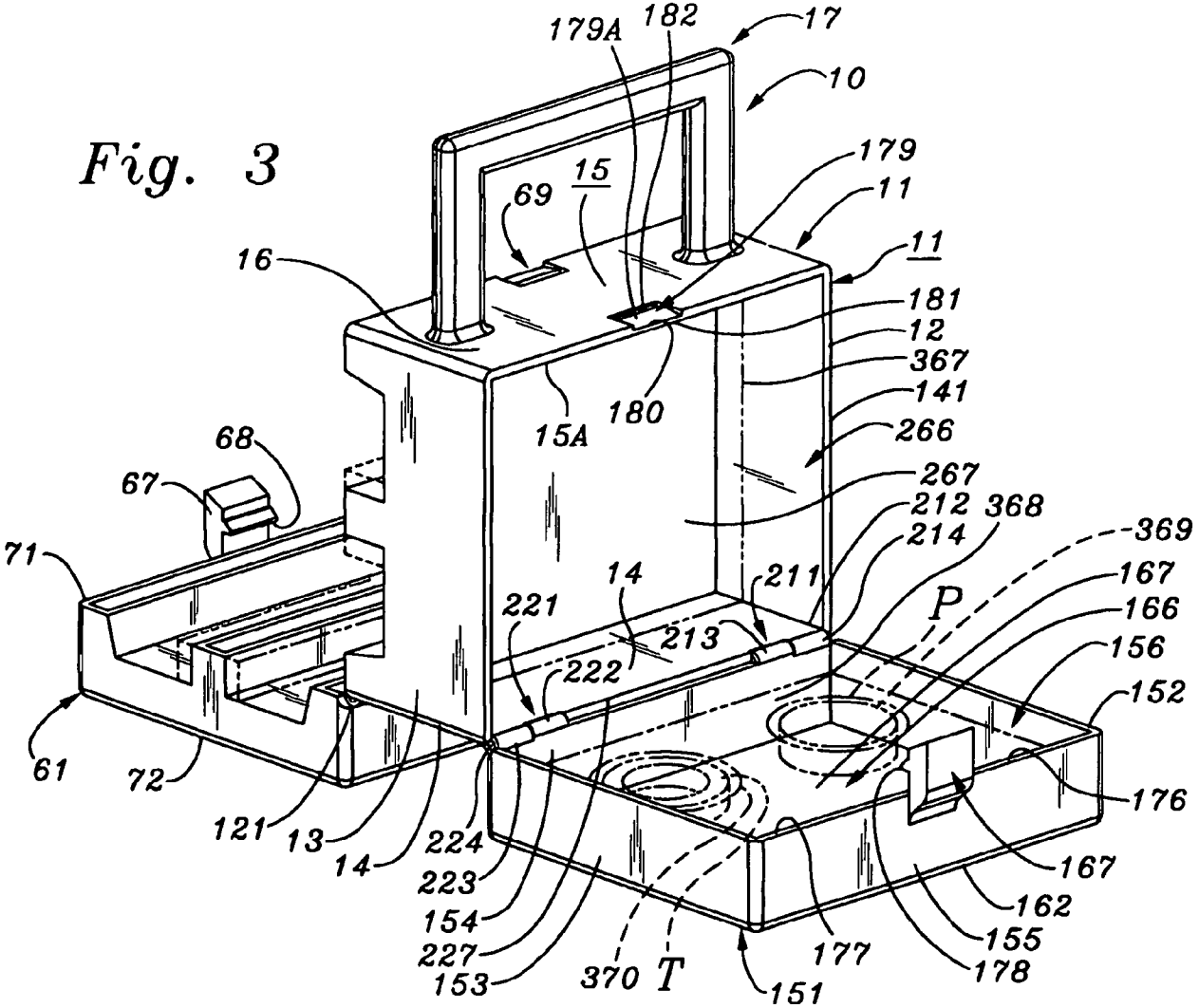
FIG. 3 is a right side perspective view of the case configured as shown in FIG. 2.

Referring now to FIGS. 1, 2, and 3, it may be seen that hockey equipment carrying case 10 includes a first, left side, hockey-stick storage compartment lid 61 Which has a rectangular side elevation view shape similar to that of left side 21 of body 11. Thus, lid 61 has generally rectangularly-shaped, vertically disposed parallel front and rear sides 62 and 63, a longitudinally and horizontally disposed rectangularly-shaped bottom side 64, and parallel, rectangularly-shaped upper side 65. Also, left side lid 61 has a flat, vertically disposed outer side surface 72, and an inner surface 71 which is parallel to the outer surface.

Figure 4:
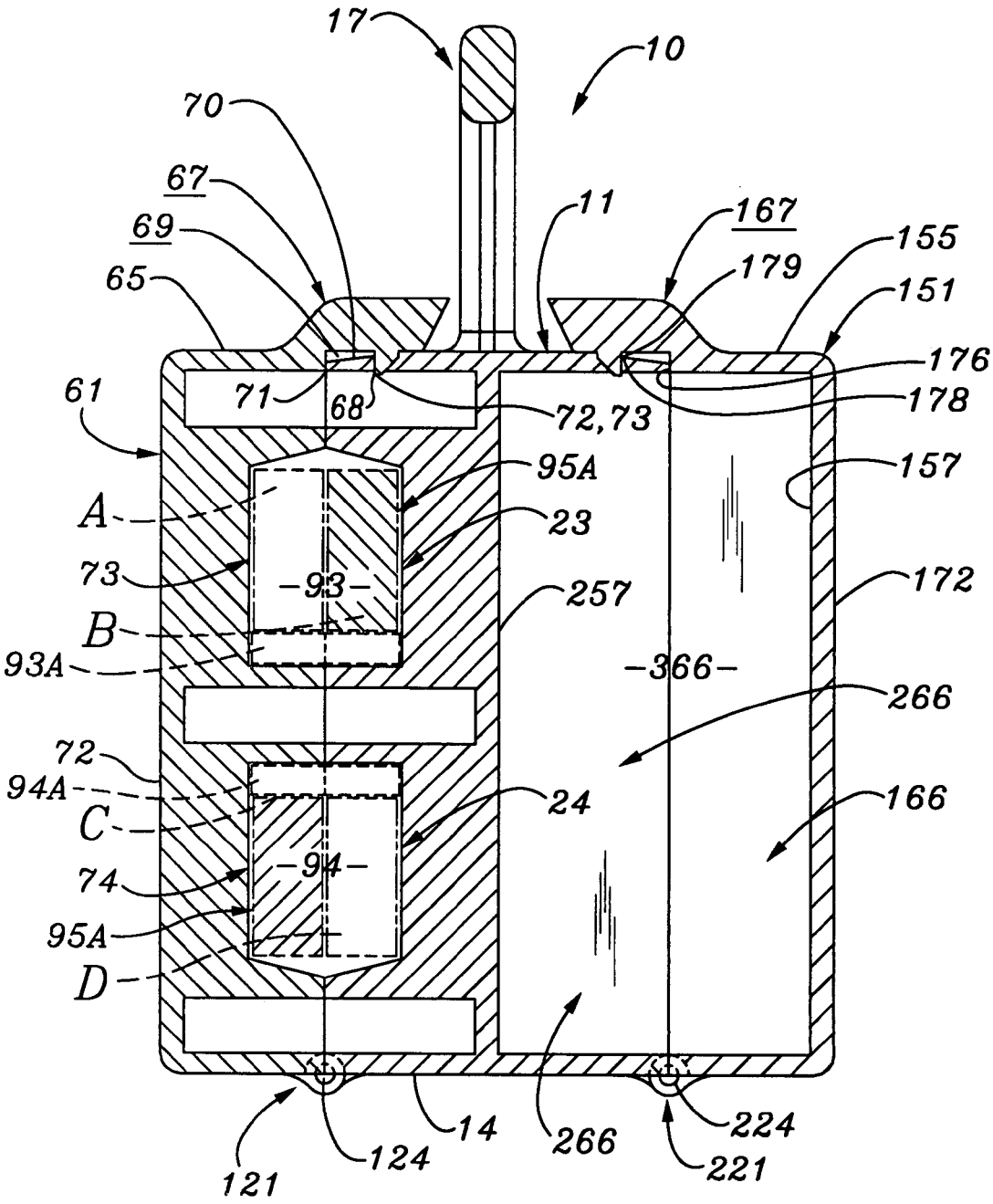
FIG. 4 is a vertical transverse sectional view of the case of FIG. 1, taken in the direction of line 4-4.
Figure 7:
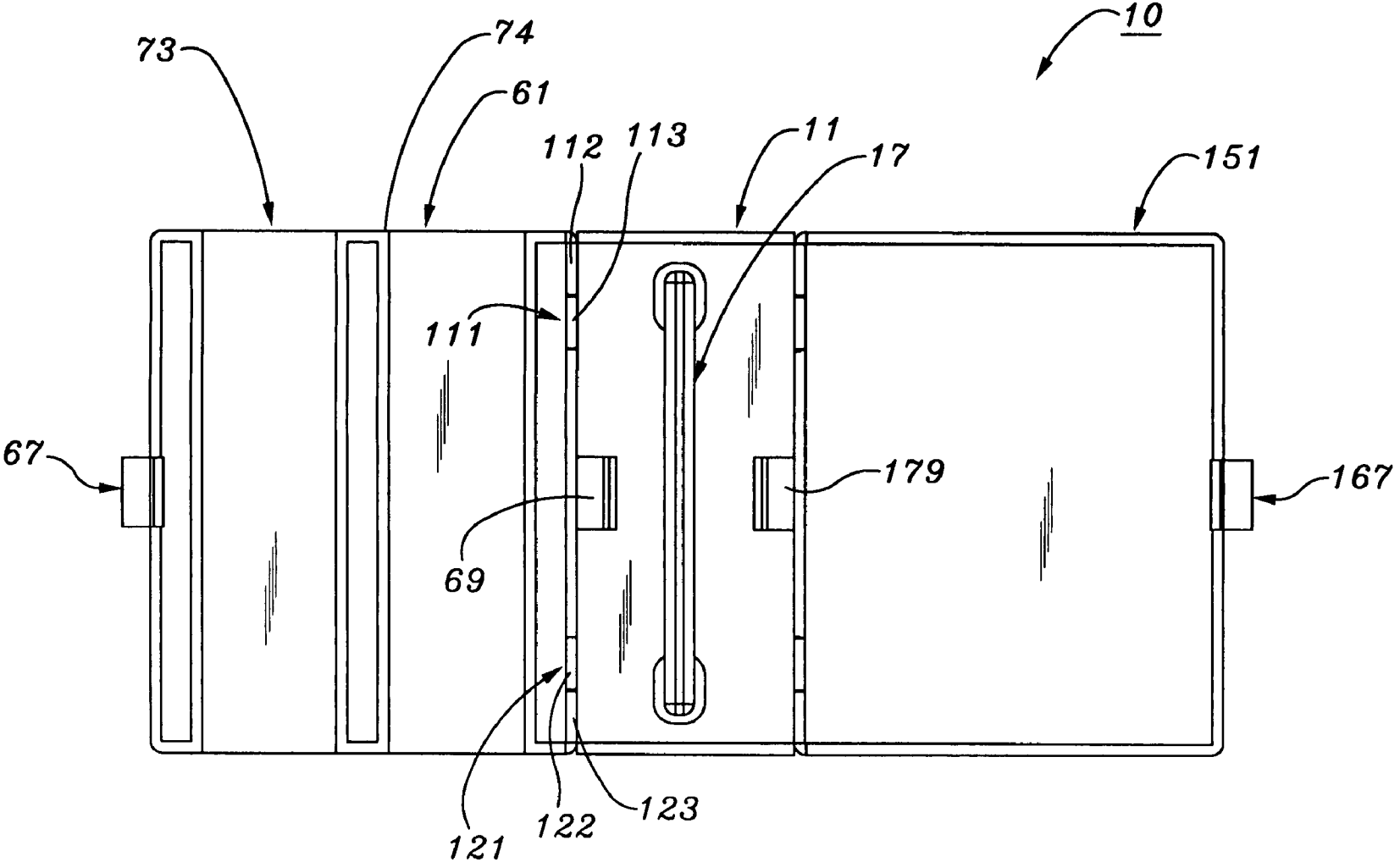
FIG. 7 is an upper plan view of the case configured as shown in FIG. 2.

Inner wall surface 71 of left side lid 61 has formed therein upper and lower vertically spaced apart open channels or troughs 73, 74. Upper and lower troughs 73, 74 of lid 61 have a shape similar to that of upper and lower troughs 23, 24 in body 11, and are located and oriented in similar locations in lid 71 to those of channels 23, 24 of body 11. Thus, with lid 61 in closed position contacting body 11, as shown in FIG. 4, upper trough 73 of lid 61 horizontally confronts upper trough 23 of body 11 to thereby form an upper, closed, rectangular cross-section upper channel 93. Similarly, lower trough 74 of lid 61 confronts lower trough 24 of body 11 to form a lower, closed, rectangular cross-section lower channel 94. Upper and lower channels 93, 94 are bordered by upper, middle, and lower lid ribs 77, 97, 87 shaped similarly to corresponding ribs 27, 47, 37, respectively of body 11.

As shown in FIGS. 1-5, stick-compartment lid 61 has attached to upper surface 65 thereof a springingly deformable fastener hook 67 which protrudes inwardly of the inner face 66 of upper lid rib 77. Fastener hook 67 has protruding downwardly therefrom and inwardly of inner face 66 of upper rib 77 a longitudinally disposed, outwardly angled, wedge-shaped tang 68. As shown in FIGS. 2 and 4, tang 68 of fastener hook 67 is adapted to engage a complementary-shaped, longitudinally disposed catch groove 69 formed in upper surface 16 of upper side 15 of body 11. As shown in FIGS. 2 and 4, catch groove 69 penetrates outer edge wall 31 of upper body rib 27, and is centered longitudinally between front side 12 and rear side 13 of body 11. As is also shown in FIGS. 2 and 4, catch groove 69 has an outwardly and downwardly disposed flat rectangularly-shaped base 70 which has an outer longitudinally disposed edge 71 that penetrates face 31 of upper body rib 27, and an inner longitudinally disposed edge 72 which has protruding downwardly therefrom into upper surface 16 of body 11, a triangular wedge-shaped notch 69A for engaging tang 68 of fastener hook 67. Preferably, as shown in FIG. 4, fastener hook 67 is made of a resilient material such as polypropylene, and molded integrally with lid 61, thus enabling clamp 67 to be resiliently and releasably engaged and disengaged with fastener groove 69, as shown in FIGS. 2 and 4.

As shown in FIG. 2, stick compartment lid 61 is pivotably joined to body 11 of case 10 by a pair of front and rear hinges 111, 121. Each hinge 111, 121 includes an outer tubular barrel 112,122 which protrudes upwardly from an upper rear edge 131 of lower rib 87 of lid 61 and an inner tubular barrel 113,123 which is coaxially aligned with the outer barrel and which protrudes outwardly from lower edge 137 of lower body rib 37. Front hinge barrels 112, 113 and rear hinge barrels 122, 123 are pivotably joined together by front and rear headed hinge pins 114, 124, respectively, which fit in coaxially aligned bores of the front and rear hinge barrel pairs, respectively. Referring now to FIG. 3, it may be seen that case 10 includes a second, accessory compartment lid 151. Accessory compartment lid 151 has an outer rectangularly-shaped side 162 which has in a right side elevation view, a size and shape substantially similar to that of right side 141 of body 11. Also, accessory compartment lid 151 has generally rectangularly-shaped, vertically disposed front and rear sides 152, 153, a longitudinally and horizontally disposed, rectangularly-shaped bottom side 154, and a parallel, similarly shaped upper side 155. As shown in FIG. 3, the above-listed sides of lid 151 are all of thin generally uniform thickness, thus forming between inner facing adjacent surfaces thereof a concave, rectangular block-shaped lid accessory storage compartment 156.

As shown in FIGS. 1-5, accessory compartment lid 151 has attached to upper side 155 thereof a springingly deformable fastener hook 167 which protrudes inwardly of the inner face 176 of upper lid rib 177. Fastener hook 167 has protruding downwardly therefrom and inwardly of inner face 176 of upper rib 177 a longitudinally disposed, outwardly angled, wedge-shaped tang 178. As shown in FIGS. 2 and 4, tang 178 of fastener hook 167 is adapted to engage a complementary shaped, longitudinally disposed catch groove 179 formed in upper surface 16 of upper side 15 of body 11. As shown in FIGS. 2 and 4, catch groove 69 penetrates outer right-hand edge wall 15A of body 11, and is centered longitudinally between front 12 and rear side 13 of the body. As is also shown in FIGS. 2 and 4, catch groove 179 has an outwardly and downwardly disposed flat rectangularly-shaped base 180 which has an outer longitudinally edge 181 that penetrates edge 15A of upper side 15 of body 11, and an inner longitudinally disposed edge 182 which has protruding downwardly therefrom into upper surface 16 of body 11, a triangular wedge-shaped notch 179A for engaging tang 178 of fastener hook 167. Preferably, as shown in FIG. 4, fastener hook 167 is made of a resilient material such as polypropylene, and molded integrally with lid 151, thus enabling clamp 167 to be resiliently and releasably engaged and disengaged with fastener groove 179, as shown in FIGS. 2 and 4.

As shown in FIG. 3, accessory compartment lid 151 is pivotably joined to body 11 of case 10 by a pair of front and rear hinges 211, 221. Each hinge 211, 221 includes an outer tubular barrel 212, 222 which protrudes upwardly from an upper rear edge 221 of base 226 of lid 151 and an inner tubular barrel 213, 223 which is coaxially aligned with the outer barrel and which protrude outwardly from lower right-hand edge 227 of base 14 of body 11. Front hinge barrels 212, 213 and rear hinge barrels 222, 223 are pivotably joined together by front and rear headed hinge pins 214, 224, respectively, which fit in coaxially aligned bores of the front and rear hinge barrel pairs, respectively.

As is also shown in FIG. 3, right side 141 of case body 11 preferably has a hollow, concave shell-like construction similar to that of accessory compartment lid 151. Thus, as shown in FIG. 3, right side 141 of case body 11 has formed between front and rear lower and upper side walls 12, 13, 14, and 15, respectively a concave, rectangular block-shaped spacer 266 which is bordered at an inner, vertical plane thereof by a vertical base wall 267. Thus, with accessory compartment lid 151 closed into fastening engagement with body 11, as shown in FIG. 4, confronting concave spaces 166, 266 of lid 151 and body 11 cooperate to form a larger rectangular block-shaped storage region 366.

As shown in FIG. 3, storage spaces 266 and 166 in body 11 and lid 151, respectively, may optionally be fitted with pads 367, 368 made of resilient material such as an elastomeric polyurethane foam, to cushion articles contained within the storage spaces. Moreover, either or both pads 367, 368 may be provided with cavities adapted to conformally hold articles, such as a cavity 369 for holding a hockey puck P, and a cavity 370 for holding a roll of tape T.

FIGS. 1, 2 and 5 illustrate modes of using hockey equipment carrying case 10. As shown in FIG. 2, handles of a pair of hockey sticks A, B may be stacked in upper trough 73 of stick-compartment lid 61, and handles of a pair of hockey stocks C, D may be stacked in lower trough 74 of lid 61. Body 11 of case 10 may then be rotated downwardly over stick compartment lid 61 (counterclockwise in the direction of the arrow in FIG. 2), thus latching fastener hook 67 of lid 61 within fastener groove 69 of body 11, and thereby retaining handles of hockey sticks A, B, C and D within channels 93, 94, as shown in FIGS. 1 and 4, whereupon body 11 and lid 61 may be rotated as a unit to an upright position, as shown in FIG. 1. Alternatively, as shown in FIG. 5, handles of sticks A, B, C and D may be placed in troughs 23, 24 of body 11, and lid 61 rotated downwardly over body 11 (clockwise in the direction of the arrow in FIG. 5), thus latching fastener hook 67 of lid 61 within body fastener groove 69. In exactly similar fashions, accessories such as hockey pucks, gloves and the like may be placed in cavity 166 of accessory compartment lid 151 or adjacent cavity 266 in the right side of body 11, and fastener hook 177 engaged within fastener groove 179, to secure the accessory compartment lid to the body. It should be noted that if a single hockey stick is placed in channel 93 or 94, thus fitting loosely therewithin, a spacer block 95A may be placed in the channel to press against and secure the stick within the channel with lid 61 secured to body 11, as shown in FIG. 4.

Hockey stick carrying case 10 according to the present invention may be made from a wide variety of materials, including wood. Preferably, case 10 is made of a molded synthetic polymer, such as polypropylene.

As shown in FIGS. 1 and 4, upper and lower hockey stick storage channels 93 and 94, respectively, are optionally and preferably fitted with upper and lower cushioning pads 93A, 94A, respectively. Pads 93A 94A are preferably made of a resilient material such as polyurethane foam and have the shape an elongated rectangular cross section block, i.e., a parallelpiped.

Figure 8:
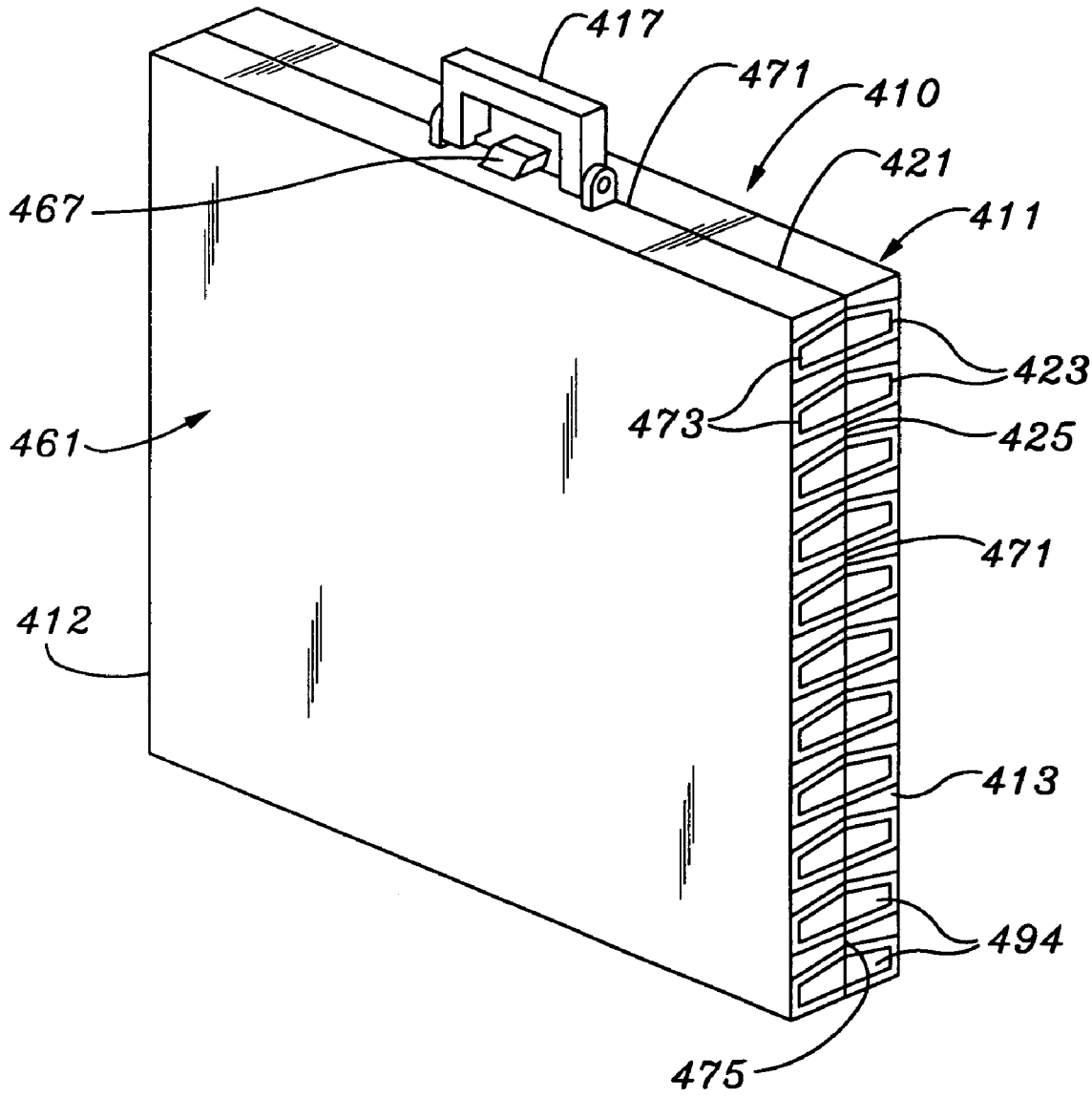
FIG. 8 is a perspective view of a modification of the hockey equipment carrying case shown in FIG. 1.

FIG. 8 is a perspective view of a modification of the hockey equipment carrying case shown in FIG. 1. Modified carrying case 410 has a vertically elongated body 411 which has formed in a vertical side thereof a plurality, e.g., ten, of longitudinally disposed, parallel, vertically paced apart open channels or troughs 423. Each trough 423 has a generally C-shaped transverse cross-section, protrudes inwardly from outer face 425 of left-hand side 421 of body 411, and penetrates front and rear sides 412 and 413 of body 411. Case 410 also includes a lid 461 which has a rectangular side elevation view shape similar to that of left side 421 of body 411. Inner wall surface 471 of lid 461 has formed therein a plurality of vertically spaced apart, open channels 473 which are mirror symmetric through a vertical plane between lid 461 and body 411 with channels 423. With lid 461 in a closed position, each pair of C-shaped channels 473-423 confront each other to form a closed, rectangular cross-section channel 494 adapted to receive the handle shafts of a pair of hockey sticks. Modified carrying case 410 also includes an upstanding handle 417, and means such as a fastener 467 of the type shown in FIG. 1, to releasably secure lid 461 to body 411.

Other modifications of case 10 which are feasible include providing stick retaining channels in either body 11 or lid 61, as well as in both, as described above.

What is claimed is:

1. A carrying case for transporting sporting equipment including hockey sticks having elongated, rectangular cross-section handle shafts, and associated accessory items including hockey pucks, said case comprising;

a. a body which has first and second longitudinally disposed sides, b. a first, stick compartment lid which has an inner side and an outer side, c. a first releasable attachment structure for releasably attaching said first lid to a first side of said body with said inner side of said lid adjacent to said first side of said body, d. at least a first longitudinally disposed, flat-bottom lid trough formed in an inner side of said lid, said lid-trough having a transversely disposed opening which is closable to form a closed channel by attachment of said lid to said body, e. at least a first longitudinally disposed, flat-bottom body-trough formed in said body, said body trough having a transversely disposed opening which confronts said opening of said lid trough when said lid is attached to said body to thereby form said closed channel, f. a resilient cushioning pad disposed longitudinally within at least one of said lid trough and said body trough, said width of the pad being of an appropriate width to span said closed channel, g. whereby with said case in an opened position, either said lid or said body may be supported in a horizontally disposed orientation with a bottom surface of said respective lid-trough or body-trough in a horizontally disposed orientation, with said transversely disposed opening thereof oriented in an upwardly facing orientation adapted to receiving and supporting at least one flat handle shaft whereupon the other of said lid or said body is movable downwardly relative to said handle shaft to close said channel and secure said shaft therewithin, said closed channel being sufficiently deep to enable a stack of at least two handle shafts to be retained within said channel with said lid attached to said body, and h. a spacer block removably placeable in said closed channel to thereby reduce width of said closed channel to a value appropriate to conform to a width of a single hockey stick.

2. The carrying case of claim 1 wherein said first releasable attachment structure for releasably attaching said first lid to said body is further defined as including in combination;

a. a first hinge mechanism joining a longitudinally disposed edge of said first lid to a first longitudinally disposed edge of said body, whereby said first lid is pivotable on an axis of said hinge mechanism from a closed position parallel to said first side of said body to an open position angled outwardly from said first side of said body, and b. a first releasable fastener for releasably holding said first lid in a closed position parallel to said first side of said body.

3. The carrying case of claim 1 further including;

a. a second, accessory compartment lid which has an inner side and an outer side, b. a second releasable attachment structure for releasably attaching said second lid to said second side of said body, c. at least a first cavity formed in at least one of said second side of said body and said inner side of said second lid, said cavity being adapted to receive accessories including hockey pucks, and d. whereby said second lid is positionable in parallel contact with said second side of said body to form between said body and said cavity a closed storage compartment for accessories.

4. The carrying case of claim 3 further including a resilient pad fitted into said cavity, said pad having formed therein openings adapted to conformally receive individual ones of said accessories.

5. The case of claim 3 further including a second cavity formed in another of said second side of said body and said inner side of said second lid, said first and second cavities being brought into confronting relationship to form an enlarged storage compartment when said second lid is attached in planar relationship to said second side of said body.

6. The case of claim 5 further including a resilient pad fitted into said cavity, said pad having formed therein openings adapted to conformally receive individual ones of said accessories.

7. The case of claim 3 wherein said second attachment structure for releasably attaching said second lid to said second side of said body is further defined as including in combination;

a. a second hinge mechanism joining a longitudinally disposed edge of said second lid to a second longitudinally disposed edge of said body, whereby said second lid is pivotable on an axis of said hinge mechanism from a closed position parallel to said second side of said body to an open position angled outwardly from said second side of said body, and b. a second releasable fastener for releasably holding said second lid in a closed position parallel to said second side of said body.

8. The case of claim 1 wherein said body is further defined as having front and rear transversely disposed sides.

9. The case of claim 8 wherein said troughs are defined as penetrating at least one of said front and rear sides of said body and said first lid.

10. The case of claim 1 wherein said body is further defined as having upper and lower transversely disposed roof and base walls, respectively.

11. The case of claim 1 further including a carrying handle which protrudes upwardly from said roof wall of said case.

12. A carrying case for transporting sporting equipment including hockey sticks having elongated, rectangular cross-section handle shafts, and associated accessory items including hockey pucks, said case comprising;

a. a block-shaped body which has first and second longitudinally disposed upright sides, front and rear transversely disposed sides, and lower and upper sides, said body having formed in said first longitudinally disposed upright side thereof at least a first, longitudinally disposed open body-channel which has a transversely disposed opening and a generally flat base wall adapted to receive and support a handle shaft of a hockey stick, b. a first, stick-compartment lid which has formed in an inner upright side thereof a first, longitudinally disposed open lid-channel which has a transversely disposed, inner facing opening which has a flat base wall adapted to confront said open body-channel and form therewith a closed channel, with said inner side of said lid in contact with said first longitudinally disposed side of said body, said closed channel being sufficiently deep to enable a stack of at least two handle shafts to be retained within said channel with said lid attached to said body c. a spacer block removably placeable in said closed channel to thereby reduce width of said closed channel to a value appropriate to conform to a width of a single hockey stick, d. a resilient cushioning pad disposed longitudinally within at least one of said lid trough and said body trough, said width of the pad being of an appropriate width to span said closed channel, e. a first hinge mechanism hingedly joining said first lid to said body and enabling one of said first lid and said body to be reversibly pivoted away from the other of said body and said lid to an open, horizontally disposed position enabling placement of at least one handle shaft in either of said lid or body channels, and pivoted into a closed position proximate said body or lid to enclose and secure said handle shaft within said composite channel, and f. a first releasable fastener structure for releasably securing said first lid to said body in said closed position.

13. The carrying case of claim 12 further including a carrying handle which protrudes upwardly from said upper side of said body.

14. The carrying case of claim 12 further including;

a. a second, accessory-compartment lid located proximate to said second longitudinally disposed side of said body which has formed in an inner side of either of said body and said second lid at least a first cavity adapted to receive accessory items including hockey pucks, b. a second hinge mechanism hingedly joining said second lid to said body and enabling said second lid to be reversibly pivoted away from said body to an open position enabling placement of said accessory items in said first cavity, and to a closed position proximate said second side of said body to thereby form between said second lid in said second side of said body a closed storage compartment for containing said accessory items, and c. a second releasable fastener structure for releasably securing said second lid to said body.

15. The carrying case of claim 14 further including a second cavity formed in another of said second side of said body and said inner side of said second lid, said first and second cavities being brought into confronting relationship to form an enlarged storage compartment when said second lid is attached in parallel relationship to said second side of said body.

16. The carrying case of claim 14 further including a carrying handle which protrudes upwardly from said upper side of said body.

17. The carrying case of claim 16 wherein said first hinge mechanism is further defined as including a hinge joining a lower edge of said first lid to a lower edge of said first longitudinally disposed side of said body.

18. The carrying case of claim 17 wherein said first releasable fastener structure is further defined as including in combination;

a. a first type of fastener element attached to said first lid, and b. a second type of fastener element attached to said body, said second type of fastener element being lockably engageable with said first type fastener element.

19. The carrying case of claim 18 wherein said first type of fastener element is further defined as being a first springingly deformable member which protrudes inwardly from an upper edge of said first lid.

20. The carrying case of claim 19 wherein said second type of fastener element is further defined as being a first groove formed in said upper side of said body near said first longitudinally disposed side of said body, said groove being adapted to lockingly engage said deformable member.

21. The carrying case of claim 19 wherein said second releasable fastener structure is further defined as comprising in combination;

a. a second springingly deformable member which protrudes inwardly from an upper edge of said second lid, and b. a second groove formed in said upper side of said body near said second longitudinally disposed side of said body, said second groove being adapted to lockingly engage said deformable member.

* * * * *